US009894985B2

(12) United States Patent
Huang

(10) Patent No.: US 9,894,985 B2
(45) Date of Patent: Feb. 20, 2018

(54) TOOTHBRUSH HEAD

(71) Applicant: Acumen Co., Ltd., New Taipei (TW)

(72) Inventor: Shou-Jen Huang, New Taipei (TW)

(73) Assignee: Acumen Co., Ltd., New Taipei (TW)

( * ) Notice: Subject to any disclaimer, the term of this patent is extended or adjusted under 35 U.S.C. 154(b) by 424 days.

(21) Appl. No.: 14/819,494

(22) Filed: Aug. 6, 2015

(65) Prior Publication Data

US 2016/0174698 A1 Jun. 23, 2016

(30) Foreign Application Priority Data

Dec. 22, 2014 (TW) ..... 103222674 U

(51) Int. Cl.

| | |
|---|---|
| ***A46B 5/00*** | (2006.01) |
| ***A46B 9/04*** | (2006.01) |
| ***A46B 9/08*** | (2006.01) |

(52) U.S. Cl.

CPC ..... *A46B 5/0041* (2013.01); *A46B 5/0066* (2013.01); *A46B 9/04* (2013.01); *A46B 9/08* (2013.01)

(58) Field of Classification Search

CPC ..... A46B 5/0041; A46B 5/0066; A46B 9/04; A46B 9/08

See application file for complete search history.

(56) References Cited

U.S. PATENT DOCUMENTS 2,172,624 A * 9/1939 Gabriel ..... A46B 11/0027 15/167.1
4,691,405 A * 9/1987 Reed ..... A46B 5/0025 15/167.1
4,776,054 A * 10/1988 Rauch ..... A46B 9/04 15/110

* cited by examiner

*Primary Examiner* — Shay Karls
(74) *Attorney, Agent, or Firm* — Alan D. Kamrath; Kamrath IP Lawfirm, P.A.

(57) ABSTRACT

A toothbrush head comprises a head base and a head frame framing the head base. The head base comprises a substrate with multiple sockets for inserting bristles. The substrate has an outer frame, a central component, and two lateral components. The outer frame comprises a space, a front inner wall, a back inner wall, and two lateral inner walls. The central component is positioned in the space of the outer frame and links to the front inner wall and the back inner wall thereof. Each of the two lateral components is positioned between the central component and each of the two lateral inner walls and links to each of the two lateral inner walls with junctions, respectively, allowing the two lateral components to be rotatable. The toothbrush head helps users to brush the teeth with Bass method without injuring the gingiva, and keeps the toothbrush clean after brushing the teeth.

10 Claims, 4 Drawing Sheets

TOOTHBRUSH HEAD

BACKGROUND OF THE INVENTION

1. Field of the Invention

The present invention relates to a toothbrush head, especially to a toothbrush head comprising a head base capable of rotating and a head frame with a soft material, allowing users to clean their teeth at a 45-degree angle with slight pressure on the gingival margin and protect the teeth and gingival from injury.

2. Description of the Prior Art

One of the reasons causing periodontal disease is cleaning the teeth in a wrong way. The most effective and correct method for cleaning teeth is Bass method by touching the bristles to the teeth at a 45-degree angle, and brushing the upper teeth with up-down processing and brushing the lower teeth with bottom-top processing from facial surfaces, occlusal surfaces to lingual/palatal surfaces of the teeth. Each part of the teeth needs to be brushed 10 to 20 times and total brushing time is at least two minutes.

A first conventional toothbrush head comprises a fixed head base anchored with bristles. However, users cannot brush the teeth at a 45-degree angle correctly with the first conventional toothbrush head.

A second conventional toothbrush head comprises a head base with a fulcrum set at a center thereof, allowing a flat of the head base to be shaken horizontally at any angle during tooth-brushing. However, users still cannot brush the teeth at a 45-degree angle correctly with the second conventional toothbrush head. Additionally, the head base is usually made of rigid material which easily causes gingival injury as the head base touches the gingiva during tooth-brushing. Moreover, solid structure of the first and second conventional toothbrush heads easily causes water to accumulate on the head base and bacteria to grow if users do not dry the toothbrush heads thoroughly.

To overcome the shortcomings, the present invention provides a toothbrush head to mitigate or obviate the aforementioned problems.

SUMMARY OF THE INVENTION

The main objective of the invention is to provide a toothbrush head for helping users to brush the teeth with Bass method without injuring the gingiva, and keeping the toothbrush head dry after brushing the teeth.

The toothbrush head in accordance with the present invention has a head base and a head frame framing the head base. The head base comprises a substrate. The substrate comprises an outer frame, a central component, two lateral components, at least one junction and multiple sockets. The outer frame comprises a receiving space. The receiving space has a front inner wall, a back inner wall and two lateral inner walls. The central component is positioned in the receiving space of the outer frame. The at least one junction links the central component to the front inner wall or to the back inner wall of the receiving space. One of the two lateral components is linked to one of the two lateral inner walls of the outer frame with the at least one junction and the other one of the two lateral components is linked to the other one of the two lateral inner walls of the outer frame with the at least one junction. The multiple sockets are formed on the central component and the two lateral components. The interspace is formed between the central component and each of the two lateral components, the front inner wall and the back inner wall of the outer frame; between one of the two lateral components and one of the two lateral inner walls of the outer frame; as well as between the other one of the two lateral components and the other one of the two lateral inner walls of the outer frame. Two junctions are formed between one of the two lateral components and one of the two lateral inner walls of the outer frame; two junctions are also formed between the other one of the two lateral components and the other one of the two lateral inner walls of the outer frame, allowing each of the two lateral components to be rotated by a single side fixation.

Bristles are inserted into the multiple sockets. The bristles inserted into the multiple sockets of the two lateral components of the substrate can be rotated at a 45-degree angle to brush the teeth and decrease brushing pressure for protecting teeth and gingival. The bristles inserted into the sockets of the central component of the substrate can be brushed vertically on the surface of the teeth for enhancing the cleaning effect.

The head base and the head frame are made of different materials. The head base is made of a rigid material, and the head frame is made of a soft material. The frame is formed inside and at a bottom rim of the head base by overmolding technique or 3D printing technique, allowing the toothbrush head to be comprised of two different materials. The toothbrush head prevents injury of the gingival caused by touching the toothbrush head to the gingival during tooth brushing. The substrate of the head base can be used as a tongue scraper.

The interspace is formed between the central component and each of the two lateral components. The interspace allows users to dry the toothbrush head thoroughly after brushing the teeth; besides, dirt blocked by the bristles of the head base is easily to be flushed away through the interspace. Moreover, the interspace allows water to be easily evaporated and prevents water from accumulating on the head base, thereby further preventing bacteria growing.

DETAILED DESCRIPTION OF THE PREFERRED EMBODIMENTS

Figure 1A:
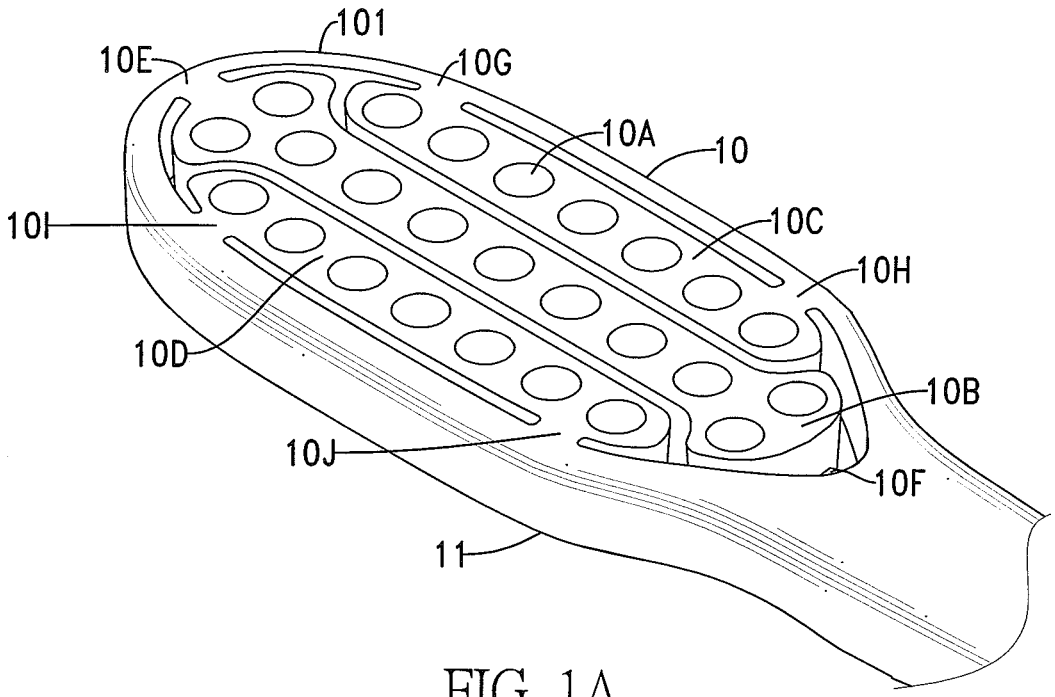
FIG. 1A is a perspective view of a head base of a toothbrush head in accordance with the present invention.
Figure 1B:
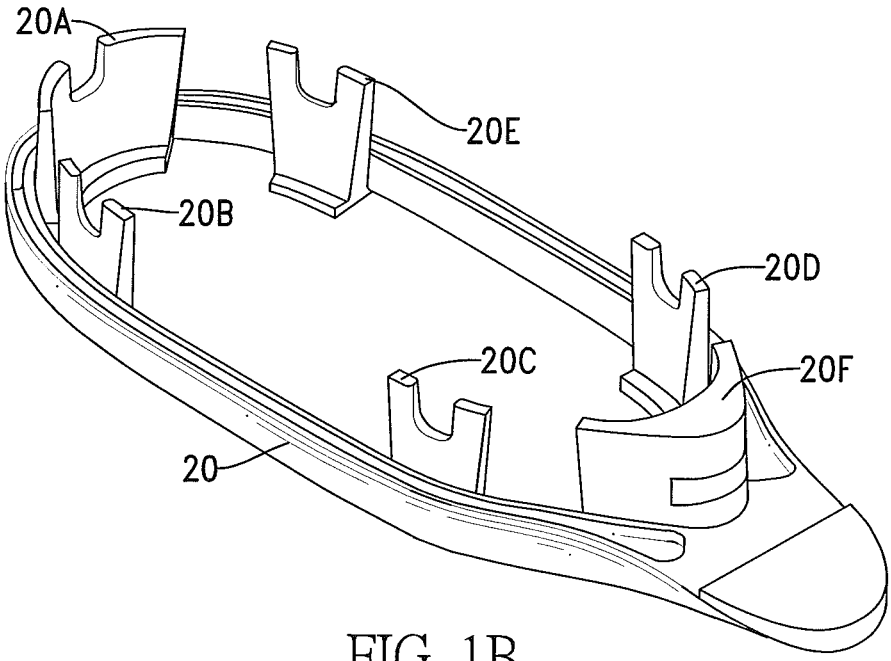
FIG. 1B is a perspective view of a head frame of the toothbrush head in accordance with the present invention.
Figure 2:
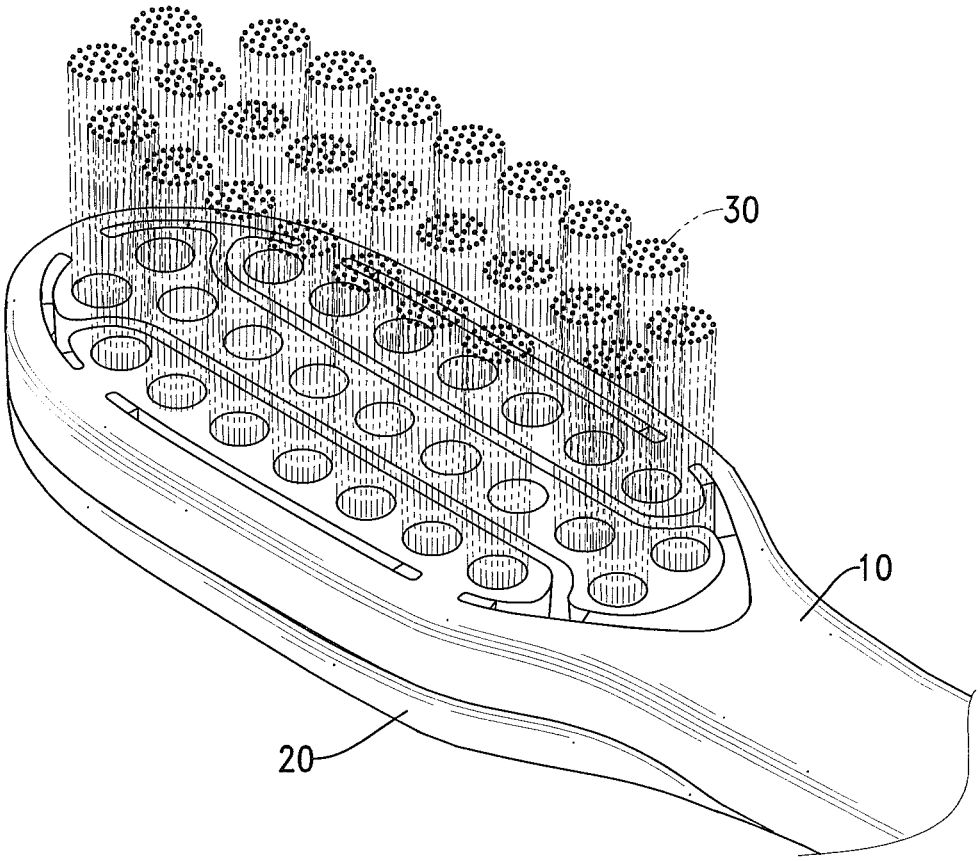
FIG. 2 is a perspective view of the toothbrush head in accordance with the present invention.
Figure 6:
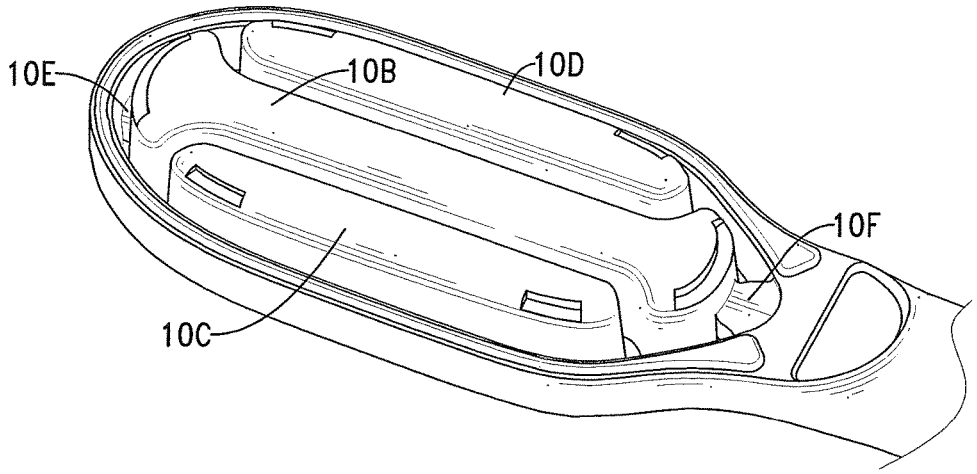
FIG. 6 is a perspective back view of the head base in FIG. 1A.

With references to FIGS. 1A, 1B and FIG. 2, a toothbrush head in accordance with the present invention comprises a head base 10 and a head frame 20 framing the head base 10. The head base 10 comprises a substrate. With reference to FIGS. 1A and 6, the substrate of the head base 10 comprises an outer frame 101, a central component 10B, two lateral components, at least one junction and multiple sockets 10A. The two lateral components comprise a first lateral component 10C and a second lateral component 10D. The at least one junction comprises a front junction 10E, a back junction 10F, a first junction 10G, a second junction 10H, a third junction 10I and a fourth junction 10J. The multiple sockets 10A are inserted by bristles 30.

The outer frame 101 comprises a receiving space, a front inner wall, a back inner wall and two lateral inner walls. The central component 10B of the head base 10 is positioned in the receiving space of the outer frame 101. The first lateral component 10C is linked to one of the two lateral inner walls of the outer frame 101 with the first junction 10G and the second junction 10H of the head base 10. The second lateral component 10D is linked to the other one of the two lateral inner walls of the outer frame 101. The first lateral component 10C and the second lateral component 10D are respectively linked to each of the two lateral inner walls of the outer frame 101 and is respectively positioned between the central component 10B and each of the two lateral inner walls to which the first lateral component 10C and the second lateral component 10D are linked, allowing the first lateral component 10C and the second lateral component 10D to be rotated by a single side fixation.

Figure 3:
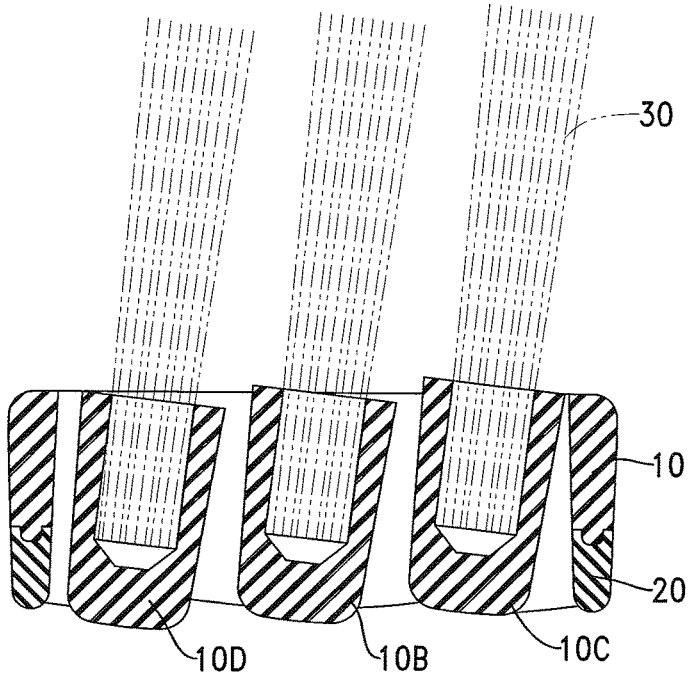
FIG. 3 is a side-sectional and end view of the toothbrush head in a usage state in FIG. 2.
Figure 4:
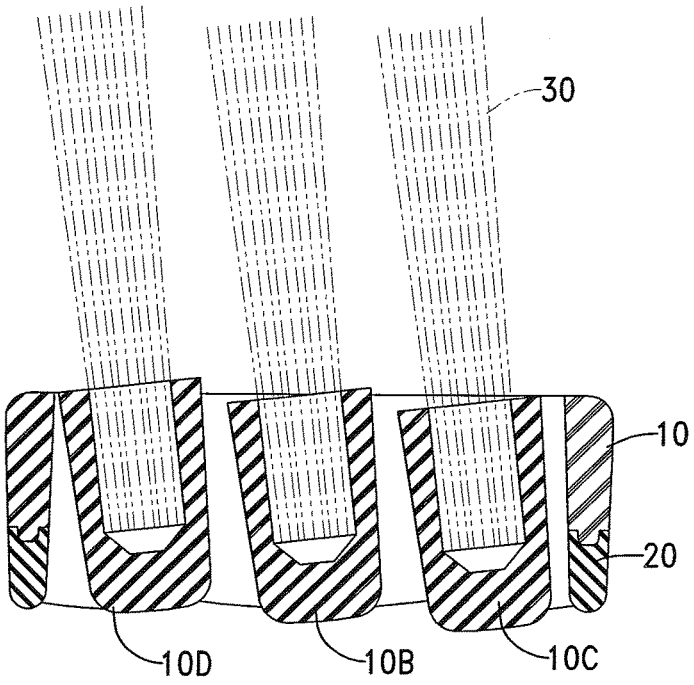
FIG. 4 is an another side-sectional and end view of the toothbrush head in a usage state in FIG. 2.
Figure 5:
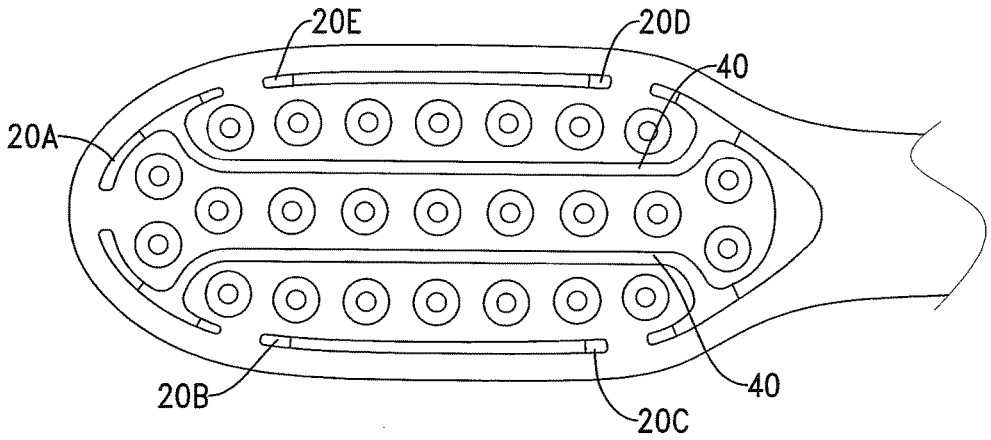
FIG. 5 is a top view of the head base in FIG. 1A.

With references to FIG. 1A and FIG. 3, the first lateral component 10C is linked to one of the two lateral inner walls of the head base 10 with a single-side linkage by the first junction 10G and the second junction 10H, allowing the first lateral component 10C to be rotatable. It allows the bristles 30 inserted in the multiple sockets 10A of the first lateral component 10C to be rotated at 45 degrees for cleaning during tooth brushing. With references to FIGS. 1A and 4, the second lateral component 10D is linked to the other one of the two lateral inner walls of the head base 10 with a single-side linkage by the third junction 10I and the fourth junction 10J. It allows the bristles 30 inserted in the multiple sockets 10A of the second lateral component 10D to be rotatable at 45 degrees for cleaning during tooth brushing. The present invention provides a toothbrush head with multiple orientations by the head base 10 with multiple bristles 30 and the head frame 101 framing the head base 10. The present invention helps users to brush teeth by Bass method and allows the bristles 30 to be bent at 45 degrees as touching and pressing the bristles 30 from the teeth to the crevices between the teeth. It allows the bristles 30 to clean the teeth and the crevices between the teeth thoroughly for decreasing the risk of causing decayed tooth and periodontal disease. With reference to FIG. 5, the amount of the central component 10B is at least one, and an interspace 40 is formed between the central component 10B and each of the two lateral components, the front inner wall and the back inner wall of the outer frame 101, between one of the two lateral components and one of the two lateral inner walls of the outer frame 101, as well as between the other one of the two lateral components and the other one of the two lateral inner walls of the outer frame 101. The interspace 40 allows users to dry the toothbrush head 10 thoroughly after brushing the teeth; besides, the dirt blocked by the bristles 30 of the head base 10 is easily to be flushed away through the interspace 40. Moreover, the interspace 40 allows water to be easily evaporated and prevents water from accumulating on the head base, thereby further preventing bacteria growing.

In another embodiment of the present invention, the amount of junctions formed on the first lateral component 10C and the second lateral component 10D of the head base 10 is at least two. The junctions of the present invention help to control the rotating orientation of the first lateral component 10C and the second lateral component 10D of the head base 10, allowing the first lateral component 10C and the second lateral component 10D of the head base 10 to be rotated in a single orientation. It also allows the bristles 30 inserted in the first lateral component 10C and the second lateral component 10D of the head base 10 to be rotated and bent at 45 degrees to thoroughly clean the teeth and crevices between the teeth for decreasing the risk of causing decayed tooth and periodontal disease.

With references to FIGS. 1A, 1B and 5, the head base 10 and the head frame 30 are made by the overmolding technique or 3D printing technique. The head base 10 is made first and the head frame 20 is formed inside and at a bottom rim 11 of the head base 10. A first protrusion 20A, a second protrusion 20B, a third protrusion 20C, a fourth protrusion 20D, a fifth protrusion 20E and a sixth protrusion 20F of the head frame 20 are respectively mounted into the front junction 10E, the third junction 10I, the fourth junction 10J, the second junction 10H and the first junction 10G of the head base 10 to form a toothbrush head with two different materials. The head base 10 is made of a rigid material, such as plastic. The head frame 20 is made of a soft material, such as silicon.

The rigid plastic material of the surface opposite to the bristles 30 inserted in the head base 10 can be used as a tongue scraper during tooth brushing. The soft material of the head frame 20 can protect the gingival from injury during tooth brushing as the head frame 20 touches the gingival.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toothbrush head comprising:

a head base comprising:

a substrate comprising:

an outer frame comprising:

a receiving space comprising:

a front inner wall, a back inner wall opposite to the front inner wall, and two lateral inner walls positioned between the front inner wall and the back inner wall;

a central component positioned in the receiving space of the outer frame and comprising:

at least one junction linking the central component to the front inner wall or to the back inner wall; and two lateral components wherein one of the two lateral components is linked to one of the two lateral inner walls with at least one junction, the other one of the two lateral components is linked to the other one of the two lateral inner walls with at least one junction; and each of the two lateral components is respectively positioned between the central component and the lateral inner walls to which the lateral component is linked; and multiple sockets formed on the central component and the two lateral components; and a head frame framing the head base.

2. The toothbrush head as claimed in claim 1, wherein interspaces are formed between the central component and each of the two lateral components, the front inner wall and the back inner wall of the outer frame, as well as between one of the two lateral components and one of the two lateral inner walls of the outer frame, as well as between the other one of the two lateral components and the other one of the two lateral inner walls of the outer frame respectively.

3. The toothbrush head as claimed in claim 2, wherein one of the two lateral components is linked to one of the two lateral inner walls of the outer frame with two junctions, and the other one of the two lateral components is linked to the other one of the two lateral inner walls of the outer frame with two junctions.

4. The toothbrush head as claimed in claim 3, wherein the head frame is formed inside and at a bottom rim of the head base.

5. The toothbrush head as claimed in claim 2, wherein the head frame is formed inside and at a bottom rim of the head base.

6. The toothbrush head as claimed in claim 1, wherein one of the two lateral components is linked to one of the two lateral inner walls of the outer frame with two junctions, and the other one of the two lateral components is linked to the other one of the two lateral inner walls of the outer frame with two junctions.

7. The toothbrush head as claimed in claim 6, wherein the head frame is formed inside and at a bottom rim of the head base.

8. The toothbrush head as claimed in claim 1, wherein the head frame is formed inside and at a bottom rim of the head base.

9. The toothbrush head as claimed in claim 8, wherein the head base is made of a rigid material.

10. The toothbrush head as claimed in claim 8, wherein the head frame is made of a soft material.

* * * * *